United States Patent [19]

Michel

[11] Patent Number: 4,687,210

[45] Date of Patent: Aug. 18, 1987

[54] TOY BOUNCING RING

[76] Inventor: James C. Michel, 1552 Faith Ct., Simi, Calif. 93063

[21] Appl. No.: 778,553

[22] Filed: Sep. 20, 1985

[51] Int. Cl.[4] ..... A63B 65/00

[52] U.S. Cl. ..... 273/425; 273/58 K; 273/428

[58] Field of Search ..... 273/425, 58 K, 428, 273/58 A, DIG. 20

[56] References Cited

U.S. PATENT DOCUMENTS

| | | | |
|---|---|---|---|
| 158,991 | 1/1875 | Smith | 273/425 X |
| 281,773 | 7/1883 | Mann | 273/425 |
| 2,078,382 | 4/1937 | Hanshaw | 273/58 K |
| 2,362,064 | 11/1944 | Giesinger | 273/58 K |
| 2,683,603 | 7/1954 | Gackenbach | 273/425 X |
| 3,487,824 | 1/1970 | Profitt | 273/425 X |
| 3,594,945 | 7/1971 | Turney | 273/425 X |
| 4,003,573 | 1/1977 | Craig, Jr. | 273/58 K |

FOREIGN PATENT DOCUMENTS

| | | | |
|---|---|---|---|
| 67929 | 1/1893 | Fed. Rep. of Germany | 273/58 A |
| 829109 | 1/1952 | Fed. Rep. of Germany | 273/DIG. 20 |
| 2639749 | 3/1978 | Fed. Rep. of Germany | 273/DIG. 20 |
| 289986 | 5/1928 | United Kingdom | 273/425 |
| 395561 | 7/1933 | United Kingdom | 273/58 A |

*Primary Examiner*—Paul E. Shapiro

*Attorney, Agent, or Firm*—Beehler, Pavitt, Siegemund, Jagger, Martella & Dawes

[57] ABSTRACT

The basic play value of predictability of rebound of a thrown or bounced object is combined with an element of unpredictability in the rebound to provide a plaything from which complex play sequences can be built. The plaything comprises a ring with an axis of symmetry about which a preferential spin can be defined. The surface of the ring includes at least one annular edge characterized by relatively small radius of curvature compared to the ring so that impact of the ring against a flat surface can, in appropriate circumstances, result in an unpredictable rebound when the annular is at or near the point of impact. Complex play sequences can then be developed by attempting to catch the rebounding ring in flight on the first rebound. Play sequences are developed which can accomodate one or an arbitrary number of players.

7 Claims, 6 Drawing Figures

TOY BOUNCING RING

BACKGROUND OF THE INVENTION

1. Field of the Invention

The invention relates to the field of toys and in particular to bouncing toys which are thrown against a surface which rebound from the surface and are caught after rebounding.

2. Description of the Prior Art

Toys, playthings and things of amusement have over the course of time generally become more complex and sophisticated, undoubtedly as a reflection of the advance in electronics and materials technologies. For example, games which are previously simply played on paper or with cardboard markers, have been computerized, such as the parlor game of Battleship, so that it is played in an apparatus with the assistance of computer supervision. The number of complex and sophisticated electronic toys has virtually exploded in recent years, giving the consumer a bewildering variety of sophisticated, complex and usually expensive playthings from which to choose.

However, despite the dramatic multiplication of the variety of playthings made available by incorporation of electronic technologies into such playthings, the market life and the degree of market penetration of any one of such electronic toys is generally limited. These toys are capable of implementing fairly complex rules and play sequences. Generally, the more complex and sophisticated the play sequence, the more limited it is in its appeal as a toy.

Therefore, it has long been recognized that the best and longest lived games and toys are those which are built upon fundamental and simple relationships which have a wide base of appeal and understanding among virtually all who would play with the object. The fascination of the play sequence then arises from the multiplicity of play sequences which can be derived from combination of a small number of fundamental play concepts. For example, the card game of contract bridge, while having very simple play rules, nevertheless is capable of supporting extremely complex play sequences by virtue of the complex and large number of combinations that can be made of the relatively few fundamental concepts upon which the game is based.

Like the fundamental concepts underlying the card game of contract bridge, games involving hand-eye coordination through the means of tossing, throwing, bouncing a ball, ring or other object can also be found as the fundamental play elements in a large number of games and playthings. Each of these games generally incorporate a basic property of motion of the thrown or bounced object. The game of tennis for example is a simple game whose object is merely the return of a bouncing ball across a net barrier into predetermined landing zones. The basis of the game is the predictability of the flight and bounce of a tennis ball. Similar statements can be made with respect to virtually any physical game involving a ball or a ring. The game of horseshoes, for example is based upon the control and predictability of the flight of an U-shaped iron horseshoe and its ultimate disposition approximate to or engagement with an iron spike. A bean bag or ring toss game is similarly based upon the predictability of flight of a weighted bag or ring through a hole in a target or onto a spike. The number of examples could be extended almost endlessly. In each case a game of hand-eye coordination bases its appeal upon the predictability of motion of a physical object with respect to another object or position.

What is needed is a toy or plaything which incorporates the traditional appeal of a plaything based upon hand-eye coordination, but which is capable of exhibiting play sequences having an element of unpredictability or unexpected movement or position which can be incorporated into the play sequence.

BRIEF SUMMARY OF THE INVENTION

The invention is a plaything adapted for bouncing comprising a body characterized by having a preferred axis of symmetry. The body is spun about the axis and is made of resilient material. The body of the plaything has an exterior surface defined on the body. The surface is characterized by mechanism for introducing unpredictability of rebound flight of the plaything.

The mechanism which produces unpredictability of rebound flight comprises a modification of the surface. The modification is characterized by a small radius of curvature compared to the surface.

In particular the plaything has a body which is a right circular cylindrical ring.

The modification of the surface is at least one annular lip extending from the surface.

More specifically the modification comprises a pair of annular lips extending from the surface. Each one of the pair of annular lips is disposed on the surface at opposing edges of the right circular cylindrical ring.

In another embodiment the modification comprises an inclined annular bevelled surface defined in the exterior surface. The modification is a pair of the inclined bevelled surfaces defined in the exterior surface. The bevelled surfaces are oppositely inclined from each other with respect to the exterior surface and in particular are oppositely inclined bevelled surfaces which are symmetrically defined into the exterior surface.

In yet another embodiment the modification comprises a crowned surface defining the exterior surface. The crowned surface further comprises at least one annular edge defined therein.

Stated in an alternative manner the invention is a toy ring adapted for bouncing comprising a body with an axis of symmetry. The body is spun about the axis of symmetry and maintains relative angular stability with respect to the spin about the axis of symmetry. The body is characterized by an exterior surface. A mechanism for producing unpredictability of rebound flight is provided and defined on the exterior surface.

The mechanism for producing unpredictability of rebound flight comprises at least one annular edge characterized by a small radius of curvature.

The invention is also a method of play for bouncing a resilient toy ring comprising the steps of throwing the ring toward a substantially unyielding flat surface; establishing a selective angular orientation of the ring during flight of the ring toward the surface; impacting the surface; and rebounding the ring in an unpredictable rebound flight path.

In the step of establishing a selected angular orientation of the ring during flight toward the surface, a portion of exterior surface of the ring is oriented towards the surface. That portion includes a mechanism for producing unpredictability of rebound flight. In particular, the step of establishing a selective orientation of the ring during flight of the ring towards the surface comprises a step of orienting at least one annular edge on the exterior surface of the ring into a position for impact with the surface during the step of impacting.

The invention may be better understood by now turning to the illustrated embodiments shown in the drawings wherein like elements are referenced by like numerals.

The invention and its various embodiments may better be understood by now turning to the following description.

DETAILED DESCRIPTION OF THE PREFERRED EMBODIMENTS

The invention is a toy or plaything generally formed in the shape of a cylindrical ring which is characterized by the mechanical motion and properties of solid right circular cylindrical rings, but which incorporates a means for introducing a degree of unpredictability or random variability in its flight when bounced. Using both the regularity of flight as well as the irregularities of its bounce, such a plaything can be incorporated into an arbitrary number of games, some of which will be briefly described below.

Figure 1A:
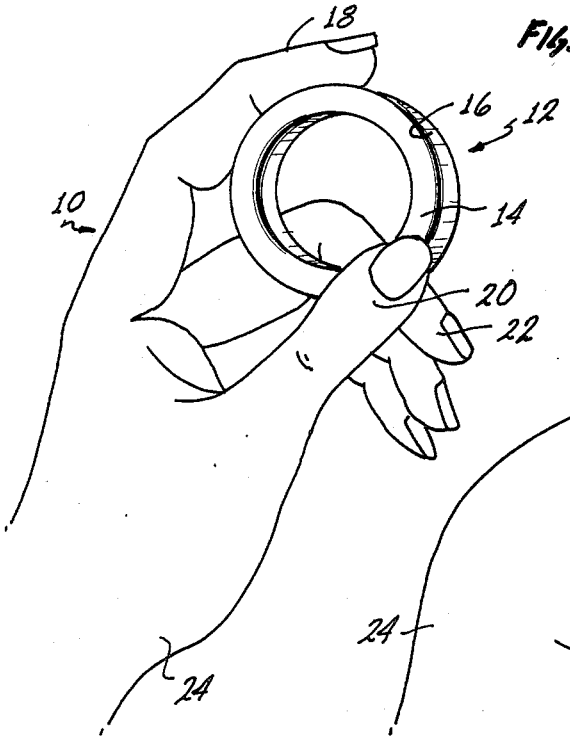
FIG. 1*a* is a perspective illustration of a ring incorporating the invention held in a position in preparation of being thrown.

Prior to considering the method of playing with the toy, first consider the object comprising the toy itself. FIG. 1 is an illustration of a user's hand, generally denoted by reference numeral 10, holding a ring, generally denoted by reference numeral 12, in preparation to throwing ring 12. In a preferred embodiment, ring 12 is a resilient polyvinylchloride (PVC), right circular cylindrical ring approximately $\frac{3}{4}$ inch wide, $\frac{1}{8}$ inch thick and with an inside diameter of approximately 1.25 inch. Rings with inside diameter in the range of 1 to 4 inches are also expressly contemplated. The inherent resiliency and fracture resistance of the PVC material, together with thickness 14 of ring 12 is sufficient to prevent its fracturing upon impact with a surface even when thrown with considerable force. Thickness of the ring is an optimization between strength and liveliness. The thinner the ring the more lively the rebound and the less the strength.

In the illustrated embodiment as shown in FIG. 1, ring 12 is held between the thumb, index finger and side of the forefinger. Index finger 16 is generally placed upon the outer flat annular surface 18 of ring 12, and the side of thumb 18 and the inside surface of forefinger 20 are each placed adjacent to opposing outer edges of ring 12 generally proximate to position of forefinger 16 on surface 18 and opposite each other. When held in this position, ring 12 can be easily tossed with a snapping wrist action and by appropriately timed release of fingers 18–22 either a forward or reverse spin can be imparted to ring 12. Through practice, the controlled application of spin to ring 12 can materially affect its rebound and hence the enjoyment of play with ring 12.

Figure 1B:
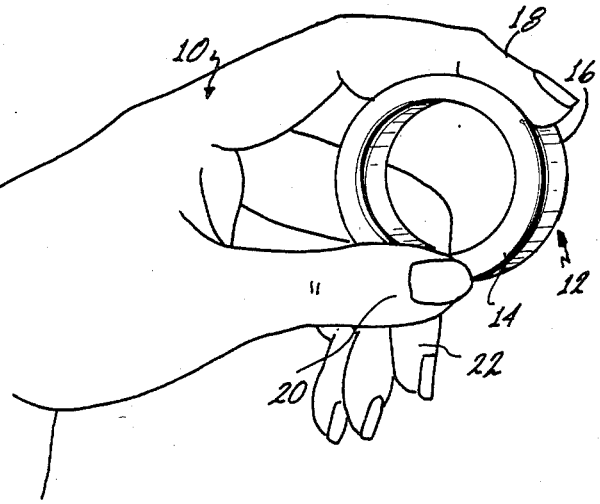
FIG. 1*b* is an illustration of the ring shown in FIG. 1*a* just prior to release of the ring as it is being thrown.

Turn for example to the illustration of FIG. 1*b* which illustrates the flexure of wrist 24 of hand 10 to impart an overall linear and rotational velocity to ring 12. Depending then on the release of fingers 18–22 with respect to each other and ring 12, varying degrees and directions of spin can be imparted to ring 12. Because of the symmetry of mass of ring 12, the spin or angular momentum is clearly defined about the longitudinal axis of symmetry of ring 12 and is maintained through the law of conservation of angular momentum as the ring 12 is first thrown. Ring 12 thus is gyroscopically stabilized during its initial flight.

Figure 2:
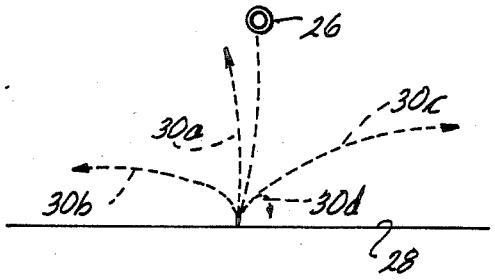
FIG. 2 is an illustration of the rebound of the ring illustrated in FIGS. 1*a*–1*b*.

Turn now to FIG. 2 wherein a surprising result of the play sequence utilizing ring 12 is illustrated. Ring 12 is diagrammatically shown as being thrown or released at point 26. It is then thrown downwardly onto a hard, generally nonyeilding surface 28, such as the floor or pavement. After impact with pavement 28 ring 12 enters into rebound flight. Interestingly, the rebound flight is entirely unpredictable and arbitrary. An example of four such possible flights are shown in FIG. 2. The flight may be directly back to or near the point of release 26, such as shown by flight path 30*a*, may be generally directed to the left as shown in FIG. 2 or may be oppositely directed to the right as shown in FIG. 2 as illustrated by path 30*c*. In fact, the rebound may be arbitrarily distributed in the azimuthal plane, which is parallel to the plane at the point of impact, in any one direction of the 360 degree range. This behavior adds significantly to the enjoyment of play. In each of these rebound flights 30*a*–*c*, the rebound has a magnitude generally equal to that which would be expected of a normally resilient body although the direction of rebound in directions 30*b* or *c* for example is entirely unexpected and unpredictable. However, ring 12 is capable of exhibiting another distinct and unpredictable class of rebounds, namely rebound flight 30*d*. Rebound flight 30*d* is characterized by a dead or substantially nonresilient rebound flight. Suddenly it is as if ring 12 decided to act as if it were made of lead and to rebound from impact not only in an unpredictable direction, but dully with a very low bounce. In other words on a certain percentage of occasions the rebound flight of ring 12 may be exactly as will be predicted or expected, namely path 30*a*. However, in just as many instances, the rebound flight can assume an arbitrary direction to one side or the other such as shown by rebound flight paths 30*b* or 30*c*, or will exhibit substantially no rebound at all as in the case of rebound flight 30*d*.

Figure 3:
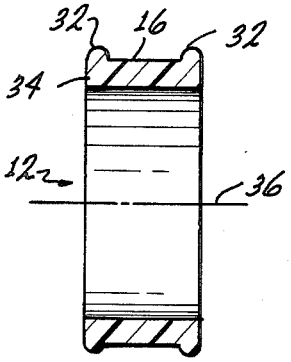
FIG. 3 is a cross-sectional view of the ring described in FIGS. 1*a* and 1*b*.

Although the physics of rebound is not entirely understood in the present application, it is believed that the unpredictability of rebound is closely associated with the curvature of the impacting surface in combination of the inherent resiliency of the material from which ring 12 is made. Turn for example to ring 12 as shown in cross-sectional view in FIG. 3. In the preferred embodiment, ring 12 in FIG. 3 includes a pair of annular lips 32 defined on the outer edges of exterior surface 16. Lips 32 are shown in FIG. 3 in exaggerated scale for the purposes of clarity. In the illustrated embodiment lips 32 radially extend approximately 0.165 to 0.170 inch from surface 16. It is to be expressly understood, however, that lips 32 may assume a variety of cross-sectional shapes and heights above surface 16 without departing from the scope of the invention. The size and shape shown in the illustrated embodiment is for the purposes of example and clarity only. Lips 32 are formed at the junction of exterior surface 16 and side surfaces 34 of ring 12. Therefore, lips 32 form an annular, raised surface characterized by a relatively small local radius of curvature. In practice, ring 12 is cut from a section of PVC pipe by means of a conventional pipe cutting tool with sufficient radial force of the cutter to plastically deform surface 16 of the pipe section on both sides of the line of cut. The deformation results in the annular lip 32 described. Alternatively, ring 12 can be molded with lips 32 defined by the mold.

It is believed that as ring 12 impacts pavement 28 as shown in FIG. 2, any slight angular tilting of ring 12 with respect to the local surface at the point of impact on pavement 28 will bring one of the pair of lips 32 in primary contact. The force of rebound then will be exerted on the pavement and ring through the area of one of lips 32 and will be significantly influenced by the local radius of curvature on the surface of ring 12 at the point of impact.

It is also believed that lips 32 significantly enhance the unpredictability of rebound, but ring 12 would rebound in a somewhat similar manner if no lips were provided and if instead the sharp or nearly zero radius of curvature of a cut edge of a ring were relied upon for play enhancement. Therefore, depending upon the degree of angular misalignment between the local perpendicular at the point of impact of pavement 28 and axis 36 of symmetry of ring 12, the rebound will assume dramatically different resultant directions as typified by paths 30*a*–30*d*. The rebound flight 30*a* of FIG. 2 would, for example, likely result when the local perpendicular at the point of impact of pavement 28 is exactly perpendicular to axis 36 of ring 12. In other words, when ring 12, which is stabilized during its initial flight due to spinning, lands nearly flat with near simultaneous contact of both of the pair of lips 32, a nearly straight or "predictable" rebound will be observed. Otherwise, the irregular rebounds as symbolically represented by paths 30*b*–30*d* will be observed.

It is this arbitrary predictability and unpredictability of the rebound of ring 12 that provides the key play element from which play sequences involving ring 12 can be made. However, before considering a few examples of such play sequences first turn to the additional embodiments illustrated in FIGS. 4 and 5.

Figure 4:
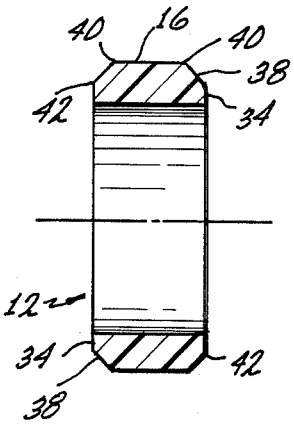
FIG. 4 is a cross-sectional view of the ring as shown in a second embodiment.

In FIG. 4 a cross-sectional view as second embodiment of ring 12 is illustrated. Surface 16 of ring 12 in FIG. 4 includes a pair of double-edged or faceted surfaces 38 contiguous to the annular radical surface 16 and side surfaces 34. The rebound characteristics of the ring as illustrated in FIG. 4 will be quite distinct from those shown in FIG. 3 in that it is likely that rebound of ring 12 will be unpredictability distributed in four directions, i.e. one direction corresponding to each edge available for rebound definition. The direct rebound on impact is made flatly with surface 16 and two side rebounds when impact is made flatly with surfaces 38. However, as can be imagined flat impact with surfaces 16 or 38 occur only occasionally and it is much more likely that slightly tilted impacts with surfaces 16 and 38 will be observed and on occasion a more obtuse impact with edges 40 defined between surface 38 and 16 on one hand, and edge 42 defined between surface 38 and 34 on the other hand. In the case when impact is made on or near edges 40 or 42, unpredictability of rebound is once again encountered due to the relatively low radius of curvature exhibited by edges 40 and 42.

Figure 5:
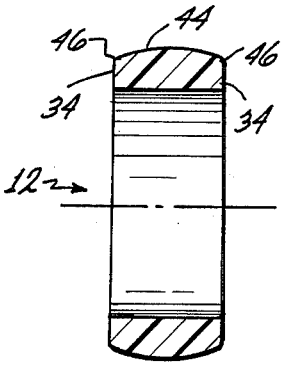
FIG. 5 is a cross-sectional view of a ring incorporating the invention as shown in a third embodiment.

FIG. 5 is directed to yet a third embodiment of the invention wherein the exterior annular surface of ring 12 has been provided with a smooth annular crown 44 extending from flat side surfaces 34. Again as expected the flight of rebound from nearly any point on crown surface 44 will be "predictable" in that there will be an expected rebound flight dependent upon the angular orientation of ring 12 as it impacts pavement 28. A ball will always bounce in the same plane at which it was first thrown due to symmetry, the inherently asymmetrical nature of spinning ring 12 is believed to cause ring 12 to bounce out of its initial plane.

It should be noted that edges 46 are defined between crowned surface 44 and flat side edges 34. Therefore edges 46 will be characterized by relatively low radius of curvature. When ring 12 impacts the pavement 28 at or near edges 46, a certain unpredictability in the rebound flight is once again observed.

The embodiment of FIG. 5 also includes a metalized layer or tape 48 disposed in the inner surface 50 of the ring. Layer 48 is highly reflective, e.g. silver or gold, and significantly enhances the play value of ring 12 by catching and reflecting any light incident on ring 12. As ring 12 rebounds and spins as described below the reflected light from layer 48 tends to give the visual impression of a rebounding sphere to ring 12.

In addition, although it is not well understood, the addition of layer 48 changes the rebound pattern as described in connection with the rings of FIGS. 3 and 4 which do not have such a layer or tape inlay. It is suspected that the weight distribution is changed and shifted slightly radially inward by layer 48 with the result that the rebound of ring 12 of FIG. 5 is noticeably more erratic and unpredictable as compared to rings not have such a layer. Thus it is to be understood, that not only is a layer 48 within inner surface 50 contemplated, but also a similar reflective, metallized layer on exterior surface 16 is included within the inventive concept. Other means for changing the weight distribution within ring 12 are also included within the invention, such as a longitudinally asymmetric distribution of mass or cross-sectional shape of ring 12 or the addition of spot weights or heavy inlays at selected points in ring 12.

Various embodiments of ring 12 as the play object now having been described, consider a few examples in the manner of which play sequences may be built up from the flight and rebound mechanics of ring 12.

Ring 12 may be played with in a solo manner by attempting to bounce ring 12 against pavement 28 and catch ring 12 during his first rebound flight. Because of the unpredictability or irregularity of the rebound of ring 12, it is difficult for an individual to be ready to move in any direction with the necessary quickness of hand and eye in order to catch ring 12 on rebound before it is out of reach. The possibility of a dead rebound regardless of the care or skill with which the ring is thrown always raises the spector of a "sudden death" miscatch. On the other hand, to a certain extent the unpredictability or predictability of the rebound can be controlled by the skill of the user who throws ring 12 to begin with. Therefore, the user can accomplish skilled play not only by having the requisite quickness to snatch a rebounding ring from the air from a nearly arbitrary flight and position, but also can affect the flight by appropriate spins and by carefully controlling the angular orientation of ring 12 at the point of impact of pavement 28. The player may then simply play against himself by attempting to consecutively catch ring 12 as many times as possible or may give points to himself by crediting himself with a single point on a straight rebound which is relatively easy to catch, double points in a case of a successful catch on an irregular rebound, and three points on a successful catch of a dead rebound. Multiple players may be pitted against each other in sequential solo plays to determine which player achieves the highest score in a given round.

The play sequences which can be fabricated between two or more players are substantially expanded. For example, in the case of two players, one player may toss the ring attempting to cause an irregular rebound while the other player positions himself oppositely to tossing player in order to catch the ring on its first rebound flight. Ring 12 is normally thrown slightly forward so that its forward motion continuous in a predictable manner although the lateral extent of its bounce is totally unpredictable. Of course there are occasions when the rebound will be essentially dead and it will be extremely unlikely that the opposing player will be able to catch the ring. Therefore, the two players may place themselves approximately 3 to 10 feet apart and throw ring 12 onto a marked square on pavement 28 equidistant between the players. On some occasions ring 12 will continue to bounce forward in a regular, predictable manner; in other cases it will rebound forwardly in arbitrary flight directions to the left or right; and in still other cases will bounce lamely in an arbitrary direction. The receiving player then attempts to catch the ring on the rebound. Upon retrieving the ring, the receiving player then becomes the throwing player and the roles are reversed. Scoring can occur in any number of ways, such as in tennis, volleyball, ping-pong, or other such games.

In the same manner as two players, four players can play in partnership. However, unlike games which use balls and predictable bounces, the four players can position themselves at the four corners of a square. Essentially then the players are formed in a circle. The ring is then tossed onto a circular target or point on pavement 28 at the center of the square or circle equidistant from all the players. The rebound of ring 12 will then be to one of the four players, possibly including the player who threw the ring itself. Each player then attempts to catch the ring in midflight on its first rebound. Upon the successful catch he can then successfully score a point for himself or his side.

Even more than four players may be accommodated in a number of play sequences. For example, a number of players can be situated in a circle as described above. Eight to ten players may be placed equidistantly around the circle. The ring is tossed to hit the target in the middle of the ring. As the player attempts to and unsuccessfully catches or fumbles the ring, he is then eliminated or may be eliminated after a number of such unsuccessful catch attempts, the number of unsuccessful attempts being equal to the number of letters in a key word or trademark of the toy, such as WhackO or the like. After each player is eliminated, the players redistribute themselves equidistantly about the ring and play continues until a single player is left remaining.

Ring 12 also accommodates itself to nonscoring games where it is simply bounced between players purely as a recreational enjoyment in itself similar to playing catch with an ordinary spherical ball.

Many modifications and alterations may be made by those having ordinary skill in the art without departing from the spirit and scope of the invention. For example, although ring 12 has been described as being a solid ring made of PVC, ring 12 can also be made of any resilient material capable of rebounding. Similarly, specific dimensions have been described above in connection with the preferred embodiment, but it is to be expected that such dimensions may be varied according to the teachings of the invention. The ring must have sufficient size and weight to be comfortably hand thrown and to generate a sufficient rebounding force after impact with pavement 28. For example, ring 12 could be fabricated in substantially the shape as illustrated in the above Figure, but instead be made from a resilient spring steel. In such an event, ring 12 generates an acoustic ringing on impact which adds to its enjoyment in the play sequence.

Furthermore, it is expressly contemplated that ring 12 will be decorated with painted designs in a number of attractive ways. For example, the pattern on exterior surface 16 could be fabricated to give a certain optical illusion of movement upon spin dependent upon the rate of spin. In addition thereto, coloration of ring 12 could be made so that different colors are generated based upon rate of rotation in a manner similar to rotating tops. As an additional surprising result of rebound flight mechanics, ring 12 will generally spin about an axis perpendicular to the axis of symmetry during rebound even when the ring assumed a stabilized flight spinning about axis 36 during its initial, pre-rebound flight. This sudden change in spin is not only surprising, but gives the ring an appearance in motion of a sphere rather than a ring. This change in appearance adds significantly to the play enjoyment.

Therefore it must be understood that the illustrated embodiment has been shown only for the purposes of example and clarity and it is not intended to limit or restrict the scope of the invention as defined in the following claims.

I claim:

1. A toy ring adapted for bouncing comprising:

a body with an axis of symmetry, said body characterized by an exterior surface; and means for producing unpredictability of rebound flight defined on said exterior surface;

wherein said means for producing unpredictability of rebound flight comprises a reflective metallized layer on at least one surface of said ring.

2. The plaything of claim 1 wherein said means for producing unpredictability of rebound flight further comprises a modification of said surface, said modification characterized by a lipped edge.

3. The plaything of claim 1 wherein said body is a right circular cylindrical ring.

4. The plaything of claim 3 wherein said modification of said surface is at least one annular beaded lip extending from said surface.

5. The plaything of claim 4 wherein said modification comprises a pair of annular beaded lips extending from said surface, each one of said pair of annular lips being disposed on said surface at opposing edges of said right circular cylindrical ring.

6. The plaything of claim 3 wherein said exterior surface of said right circular cylindrical ring includes an exterior radial surface and two adjacent end surfaces, said exterior radial surface characterized by a smooth convex cross-sectional shape.

7. The toy ring of claim 1 wherein said means for producing unpredictability of rebound flight further comprises at least one annular edge characterized by a small radius of curvature.

* * * * *